United States Patent [19]

Kozai

[11] 3,965,464

[45] June 22, 1976

[54] DEVICE FOR AUTOMATICALLY DETECTING OVERLOAD ON AERIAL LADDER TRUCK

[75] Inventor: Tetsuo Kozai, Osaka, Japan

[73] Assignee: Morita Pump Kabushiki Kaisha, Osaka, Japan

[22] Filed: Nov. 21, 1974

[21] Appl. No.: 525,930

[52] U.S. Cl. ..... 340/267 C; 182/18

[51] Int. Cl.[2] ..... G08B 19/00

[58] Field of Search ..... 340/267 C; 182/18, 19

[56] References Cited

UNITED STATES PATENTS

| | | | |
|---|---|---|---|
| 2,030,529 | 2/1936 | Nash | 340/267 C |
| 2,346,066 | 4/1944 | Conrad | 340/267 C |
| 2,418,576 | 4/1947 | Conrad | 340/267 C |
| 2,615,609 | 10/1952 | Balogh et al. | 182/19 |

*Primary Examiner*—David L. Trafton

*Attorney, Agent, or Firm*—Hall & Houghton

[57] ABSTRACT

A safety device is provided for association with an aerial ladder truck assembly to automatically detect a weight overload on the ladder unit of the assembly at any given angle. The safety means are characterized by providing ladder angle detecting means in the form of a disk provided with a plurality of contacts and a pointer operatively associated with the ladder which engages a given contact at a given angle position of the ladder, and a load indicating means which actuate a pointer mounted on a disk provided with a plurality of contacts, each of which indicates a load value with the angle indicating contacts and the load indicating contacts of each disk being electrically connected to one another and an alarm device to give an alarm when there is a weight overload on the ladder unit at the angle it is positioned.

4 Claims, 4 Drawing Figures

DEVICE FOR AUTOMATICALLY DETECTING OVERLOAD ON AERIAL LADDER TRUCK

BACKGROUND OF THE INVENTION a. Field of the Invention

The present invention relates to a device for automatically detecting an overload on an aerial ladder truck.

Generally, in an aerial ladder truck, the operator carefully operates the ladder so that the load will not exceed the working limit range on the basis of a working limit range diagram as shown in FIG. 1 taking into account the strengths of the ladder and other parts and the safety of the truck against toppling. Therefore, the truck is usually provided with a warning device or an automatic stopping device which operates in accordance with said working limit range diagram.

b. Description of the Prior Art

The conventional warning or automatic stopping arrangement, as shown in FIG. 2, comprises a load detecting cylinder 3 disposed adjacent the ladder support point 2 of a ladder support frame 1, a pressure switch 4 into which the pressure in the cylinder is introduced, a load detecting rod 5 which is pressed by the lower surface of a ladder 6 to detect the pressure in the cylinder, the arrangement being such that when said pressure takes a value specified by the pressure switch, a warning device or automatic stopping device (not shown) is actuated by the action of the pressure switch.

In this connection, a detection pressure to the load detecting cylinder produced by a front end load should be the same regardless of whether the ladder assumes a condition A or B shown in the diagram of FIG. 1. However, the pressure due to the self-weight of the ladder is greater in the condition B than in the condition A since the center of gravity of the ladder is located more outwardly in the condition B than in the condition A. Thus, eventually the detected pressure is greater in the condition B than in the condition A. If the detected pressure in the condition A is selected as the specified pressure of the pressure switch, then in the condition B the pressure switch reaches the specified pressure and the warning device or automatic stopping device is actuated before the working range is reached. This is due to the fact that the pressure actually detected by the load detecting cylinder differs between the conditions A and B.

SUMMARY OF THE INVENTION

The present invention is adapted to detect a load acting on the support portion of a ladder and the vertical angle of the ladder so that the safety working range of the ladder may be set in an optimum condition in each case.

The construction of the invention will now be described with reference to the drawings showing an embodiment thereof.

DESCRIPTION OF THE PREFERRED EMBODIMENT

Figure 3:
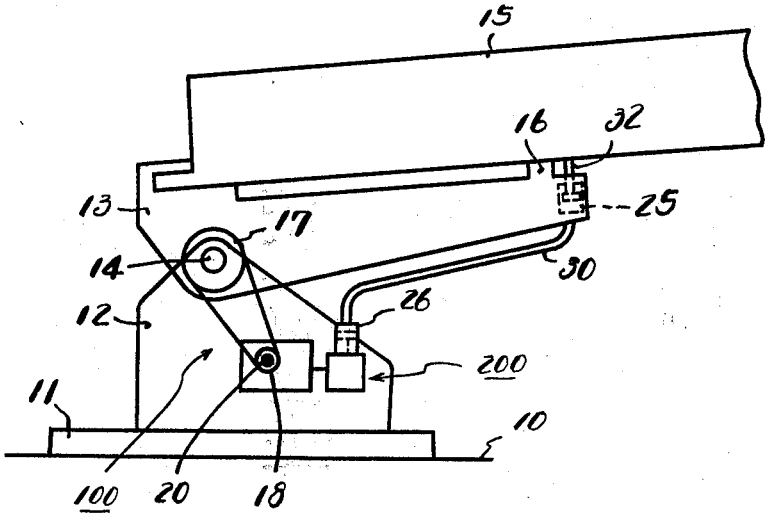
FIG. 3 is a view of a device according to the present invention.
Figure 4:
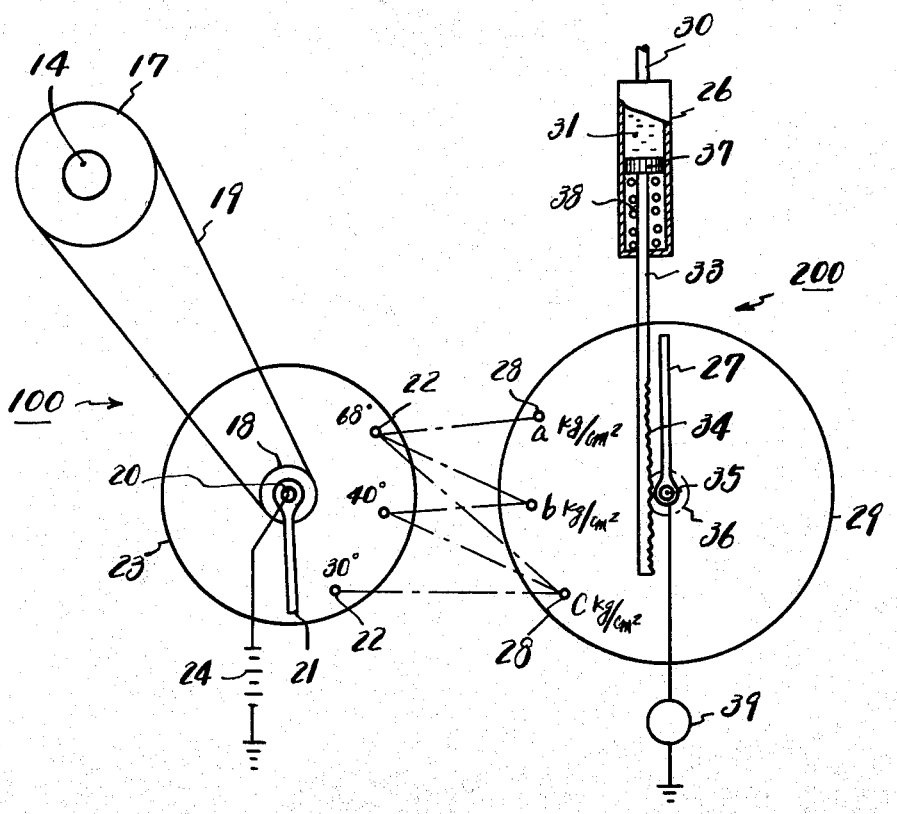
FIG. 4 is an explanatory view of the principal portions of the device of the present invention.

Reference is now to be had to FIGS. 3 and 4 wherein a portion of an aerial ladder truck is shown which includes a truck body 10, a turntable 11 mounted thereon, a ladder support block 12 mounted on the turntable 11, a ladder support frame 13 mounted on the turntable 11 by means of a shaft 14 so that the support frame 13 is vertically swingable relative to the ladder support block 12 by means of a hydraulic cylinder (not shown), a ladder assembly 15 mounted at its lower end to the ladder support frame 13, and stop means 16 associated with the support frame 13 to stop the ladder movement, the ladder assembly otherwise being suitably supported at its lower end to the support frame 13 so that it will not slip down or jump up.

The constructions of vertical angle detecting means 100 and load detecting means 200 which constitute the principal portions of the present invention will now be described. The vertical angle detecting means 100 of the ladder assembly comprises a first chain wheel 17 fixed to the rotary shaft 14, a second chain wheel 18 mounted on the ladder support block 12, a chain 19 connecting the two chain wheels 17 and 18, an angle pointer 21 secured to the rotary shaft 20 of the second chain wheel 18, and a fixed disc 23 having a plurality of contacts 22 arranged thereon in a circle. The contacts 22 mounted on the fixed disc 23 are arranged so that they are successively contacted by the angle pointer 21 when the ladder is vertically swung through predetermined successive angles. In the arrangement shown in the drawing, they are contacted by the angle pointer 21 when the vertical angle of the ladder is 30°, 40° and 68°. In addition, the character 24 designates an electric power source having its negative pole grounded and its positive pole connected to the rotary shaft 20.

The load detecting means 200 comprises a first liquid pressure producing cylinder 25 installed adjacent the stop 16, a second cylinder 26 provided on the ladder support block 12 and adapted to be actuated by the liquid pressure from the first cylinder, a load pointer 27 adapted to be rotated through an angle proportional to the liquid pressure of the second cylinder, and a fixed disc 29 having a number of contacts arranged thereon in a circle. The contacts provided on the fixed disc 29 are arranged so that they are contacted by the load pointer 27 when the load acting on the stop 16 reaches $c$ Kg/cm$^2$, $b$ Kg/cm$^2$ and $c$ Kg/cm$^2$ (where $c$ $b$ $a$). The first and second cylinders 25 and 26 are interconnected by a pipe 30, and the two chambers interconnected by the pipe 30 are liquid-tightly filled with liquid 31. The piston rod 32 of the first cylinder 25 abuts against the rear surface of the ladder, while the piston rod 33 of the second cylinder 26 is formed with a rack 34, which meshes with a pinion 36 fixed to the rotary shaft 35 of the load pointer 27. The piston rod 37 of the second cylinder 27 is acted upon by a spring 38 which acts against the liquid pressure. A warning device or automatic stopping device 39 is provided in a suitable place on the truck body and electrically connected to the rotary shaft 35 of the load pointer 27.

The contacts 22 on the fixed disc 23 of the vertical angle detecting means 100 are electrically connected to the contacts 28 on the fixed disc 29 of the load detecting means 200 in a manner shown in FIG. 4.

Thus, as the vertical angle of the ladder is increased, the load detected by the load detecting means 200 is decreased even if the same load acts on the ladder. In order to cope with this situation, the contact corresponding to the vertical angle of 30° is connected to the contact at $c$ Kg/cm²; the contact corresponding to 40° is connected to the contact at $b$ Kg/cm²; and the contact corresponding to 68° is connected to the contact at $a$ Kg/cm². In this case, the detected pressures are in the relation $a<b<c$. That is, as the vertical angle is decreased, the detected pressure is increased.

In addition, in FIG. 4, the contact at 68° is connected to the contacts at $a$ Kg/cm², $b$ Kg/cm² and $c$ Kg/cm². This is an example of an arrangement in which with the ladder taking a vertical angle of 68°, when the pressure detected by the load detecting means 200 is a Kg/cm² or above, the warning device or automatic stopping device 39 is actuated. This means that when the vertical angle is 68°, the means 39 is actuated at the pressure of $a$ Kg/cm² and also actuated at the pressures of $b$ Kg/cm² and $c$ Kg/cm² which are greater than $a$ Kg/cm².

Within the same meaning, the contact at 40° is connected to the contact at $b$ Kg/cm² and also to the contact at $c$ Kg/cm² .

Similarly, the contact at 30° is connected to the contact at $c$ Kg/cm² and to other contact or contacts (not shown) corresponding to pressure or pressures greater than said $c$ Kg/cm².

The operation of the warning device or automatic stopping device 39 will now be described.

Assume that the vertical angle of the ladder is 68° and that at this vertical angle, the working limit pressure of the ladder is set at a Kg/cm². If the load pointer 27 of the load detecting means 200 indicates a Kg/cm², an electric current flows from the power source 24 through the pointer 21, 68° contact, a Kg/cm² contact and pointer 27 into the warning device or automatic stopping device 39, whereby the latter is actuated. It goes without saying that with the ladder taking a vertical angle of 68°, when the pointer 27 of the load detecting means detects a load of above $a$ Kg/cm², said device 39 is actuated. Therefore, the device 39 is actuated when the pointer 27 is contacted with a contact corresponding to a pressure greater than $a$ Kg/cm², such as $b$ Kg/cm² and $c$ Kg/cm².

Further, with the vertical angle of the ladder being 40°, when the pointer 27 of the load detecting means 200 indicates $b$ Kg/cm², the device 39 is actuated, and it is also actuated when the pointer 27 indicates $a$ Kg/cm², which is greater than $b$ Kg/cm².

Further, with the vertical angle of the ladder being 30°, when the detected pressure is $c$ Kg/cm² or above, the device 39 is actuated.

In addition, it is necessary to put a diode in each line so that electric current does not flow from the fixed disc 29 of the load detecting means 200 to the fixed disc 23 of the vertical angle detecting means 100.

In brief, according to the present invention, the two means 100 and 200 are adapted to be independently operated so that when a predetermined condition is established the warning device or automatic stopping device 39 is actuated. Upon actuation of the device 39, the operator manipulates the ladder to the safety side.

With the above-mentioned arrangement, toppling of the ladder truck during ladder operation can be avoided. In any operating conditions including the vertical angle and degree of extension of the ladder, the bending moment, compression and tensile stresses in the ladder itself can be maintained within the allowable ranges.

Figure 1:
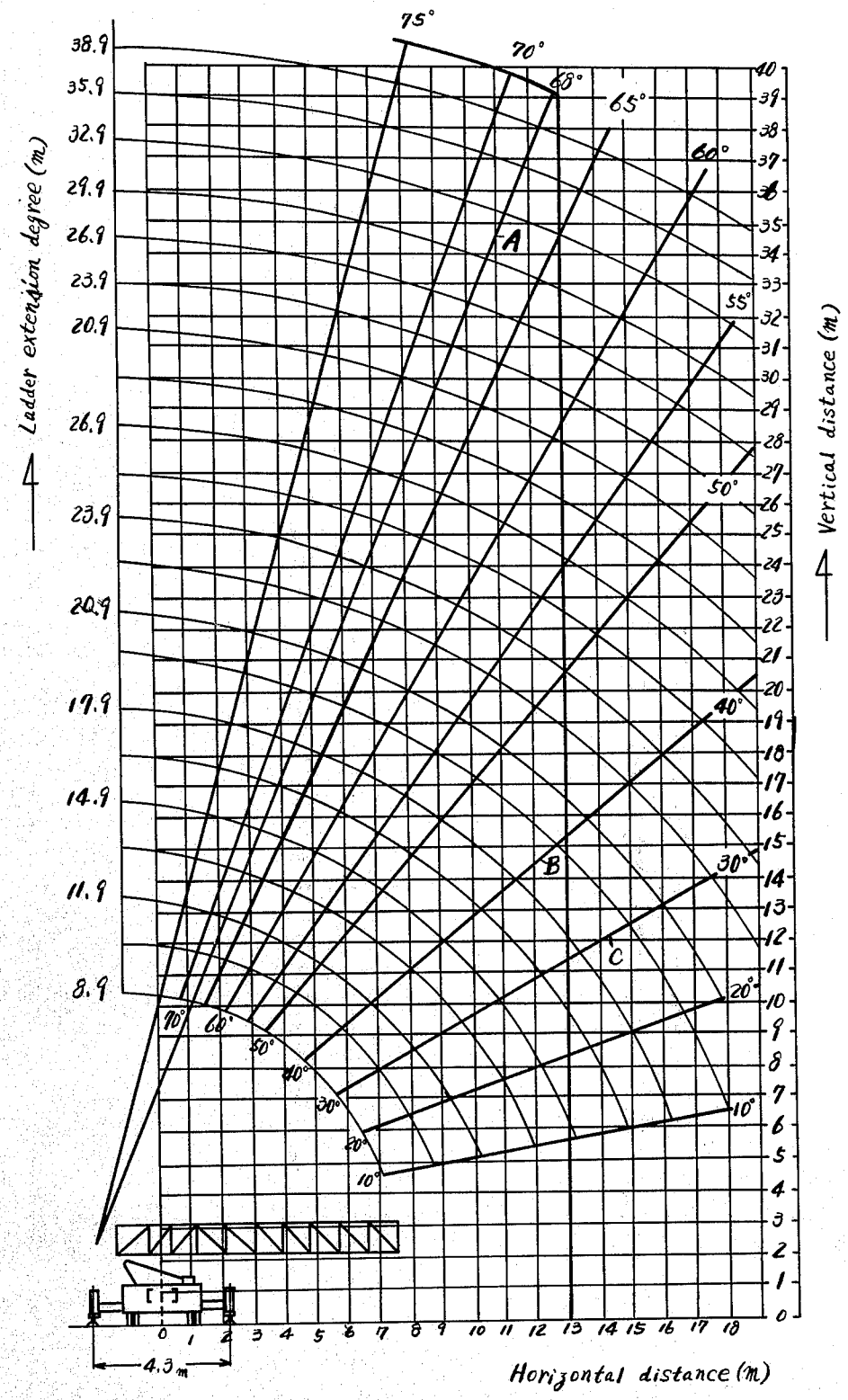
FIG. 1 is a working limit range diagram for an aerial ladder truck.
Figure 2:
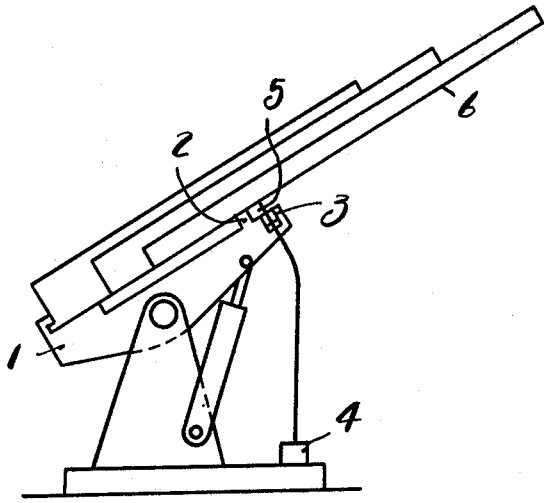
FIG. 2 is an explanatory view of a conventional device.

In other words, according to the conventional pressure detecting system shown in FIG. 2, if a load acting on the ladder is represented by $w$, the distance form the load detecting cylinder to the loaded point by L and the vertical angle of the ladder by $\alpha$, then the detected pressure $p$ is:

$$p \sim Lw \cos\alpha$$

Thus, the value of $p$ is increased as the ladder approaches the horizontal, or conversely, it is descreased as the ladder approaches the vertical. In an extreme case, if the ladder is erected upright, the $\alpha$ is 90° and hence cos is zero, so that the value of $p$ is zero. In this condition, therefore, however high the load $w$ may be, the danger cannot be detected. In such condition, if the load $w$ is increased, a compressive load is applied to the ladder causing buckling of the ladder, so that there is the danger of the ladder being broken.

The present invention is capable of coping with such situation.

Whiles there have been described herein what are at present considered preferred embodiments of the several features of the invention, it will be obvious to those skilled in the art that modifications and changes may be made without departing from the essence of the invention.

It is therefore to be understood that the exemplary embodiments thereof are illustrative and not restrictive of the invention, the scope of which is defined in the appended claims and that all modifications that come within the meaning and range of equivalency of the claims are intended to be included therein.

What is claimed is:

1. In an aerial ladder truck assembly having a truck body, a turntable unit mounted on the truck body, ladder support block means mounted on the turntable unit, horizontal shaft means mounted on the support block means, ladder support frame means mounted on the horizontal shaft means of the ladder support block means for vertically swinging relation therearound, ladder means mounted at one end to the ladder support means and stop means for the ladder means, the improvement of safety means for automatically detecting a weight overload on the ladder means at any given angle comprising ladder vertical angle detecting means mounted on the ladder support block means, said ladder angle detection means including disk means having a plurality of contacts denoting successive angle positions mounted thereon and angle position pointer means pivotally mounted for movement relative to said disk means from angle contact to angle contact, said movement being actuated by movement of the ladder means to correspond to the actual angle position of the ladder means, ladder load detecting means to denote the weight load on said ladder means, said load detecting means including load detecting fluid operated cylinder means actuatable by a load placed on the stop means of the ladder means, disk means containing a plurality of load indicating contacts positioned therearound, each of said load indicating contacts denoting a specific weight per square centimeter load value, a load pointer mounted for movement relative to said disk means from load contact to load contact, said pointer movement actuated by pressure from the fluid operated cylinder means to indicate the load placed on the ladder means, said angle indicating contacts and said load indicating contacts being electrically connected to one another, and an electrically actuated warning device electrically connected to said angle indicating contacts and said load indicating contacts whereby when a weight load placed on the ladder means exceeds the predeterminted weight limit loads for the respective vertical angles, a warning signal will be given.

2. A safety device in accordance with claim 1, wherein said fluid operated cylinder means includes a first fluid operated cylinder mounted adjacent to and operated by the stop means, a second fluid operated cylinder mounted on said ladder supported block means, and connection means between said first cylinder means and said second cylinder means, said second cylinder means being actuated by the fluid pressure of said first cylinder means and the load indicating pointer means being actuated by the fluid pressure of said second cylinder means.

3. A safety device in accordance with claim 1, wherein the ladder vertical angle detecting means include first rotatable drive means mounted on said shaft means of said ladder support frame means for rotation therewith, second drive means mounted on said ladder support block means and operatively connected to the angle indicating pointer means, and chain driving means connected to said first drive means and said second drive means whereby a rotation of the shaft means of the ladder support frame means will rotate the angle indicating pointer means.

4. A safety device in accordance with claim 2, wherein the ladder vertical angle detecting means include first rotatable drive means mounted on said shaft means of said ladder support frame means for rotation therewith, second drive means mounted on said ladder support block means and operatively connected to the angle indicating pointer means, and chain driving means connected to said first drive means and said second drive means whereby a rotation of the shaft means of the ladder support frame means will rotate the angle indicating pointer means.

* * * * *